US006951838B1

(12) United States Patent
Weuthen et al.

(10) Patent No.: US 6,951,838 B1
(45) Date of Patent: Oct. 4, 2005

(54) DETERGENT TABLETS

(75) Inventors: Manfred Weuthen, Langenfeld (DE); Bernd Fabry, Korschenbroich (DE)

(73) Assignee: Cognis Deutschland GmbH & Co. KG, Duesseldorf (DE)

( * ) Notice: Subject to any disclaimer, the term of this patent is extended or adjusted under 35 U.S.C. 154(b) by 191 days.

(21) Appl. No.: 10/088,340

(22) PCT Filed: Sep. 6, 2000

(86) PCT No.: PCT/EP00/08687

§ 371 (c)(1),
(2), (4) Date: Jun. 25, 2002

(87) PCT Pub. No.: WO01/19951

PCT Pub. Date: Mar. 22, 2001

(30) Foreign Application Priority Data

Sep. 15, 1999 (DE) ..... 199 44 218

(51) Int. Cl.[7] ..... C11D 17/00; C11D 11/00
(52) U.S. Cl. ..... 510/446; 510/294; 510/298
(58) Field of Search ..... 510/446, 294, 510/298, 447

(56) References Cited

U.S. PATENT DOCUMENTS

| | | | | |
|---|---|---|---|---|
| 3,366,570 | A | 1/1968 | Slob | |
| 3,594,324 | A | 7/1971 | Sayers et al. | |
| 3,957,967 | A * | 5/1976 | L'Orange | 424/48 |
| 3,966,629 | A | 6/1976 | Dumbrell | |
| 4,062,647 | A | 12/1977 | Storm et al. | |
| 4,076,800 | A * | 2/1978 | Marsh et al. | 424/70.14 |
| 4,118,332 | A * | 10/1978 | Apostolatos et al. | 514/164 |
| 4,524,009 | A | 6/1985 | Valenty | |
| 4,639,325 | A | 1/1987 | Valenty et al. | |
| 4,664,839 | A | 5/1987 | Rieck | |
| 4,737,306 | A | 4/1988 | Wichelhaus et al. | |
| 4,816,553 | A | 3/1989 | Baur et al. | |
| 4,985,553 | A | 1/1991 | Fuertes et al. | |
| 5,002,695 | A | 3/1991 | Schulz et al. | |
| 5,356,607 | A | 10/1994 | Just | |
| 5,374,716 | A | 12/1994 | Biermann et al. | |
| 5,494,488 | A | 2/1996 | Arnoldi et al. | |
| 5,501,814 | A | 3/1996 | Engelskirchen et al. | |
| 5,541,316 | A | 7/1996 | Engelskirchen et al. | |
| 5,576,425 | A | 11/1996 | Hill et al. | |
| 5,580,941 | A | 12/1996 | Krause et al. | |
| 5,688,930 | A * | 11/1997 | Bertho et al. | 536/18.6 |
| 5,780,420 | A | 7/1998 | Breuer et al. | |
| 5,821,360 | A | 10/1998 | Engelskirchen et al. | |
| 5,830,956 | A | 11/1998 | Stockhausen et al. | |
| 5,959,101 | A | 9/1999 | Engelskirchen et al. | |
| 6,051,544 | A * | 4/2000 | Lang et al. | 510/446 |
| 6,075,001 | A | 6/2000 | Wilde | |
| 6,153,576 | A | 11/2000 | Blum et al. | |
| 6,187,055 | B1 | 2/2001 | Kottwitz et al. | |
| 6,200,946 | B1 | 3/2001 | Blum et al. | |

FOREIGN PATENT DOCUMENTS

| | | |
|---|---|---|
| CA | 981141 | 7/1973 |
| DE | 12 90 282 | 5/1961 |
| DE | 19 26 027 | 12/1969 |
| DE | 23 34 899 | 7/1973 |
| DE | 25 53 900 | 12/1975 |
| DE | 0 164 514 | 4/1985 |
| DE | 35 26 405 | 7/1985 |
| DE | 0 280 223 | 2/1988 |
| DE | 0 301 298 | 7/1988 |
| DE | 0 496 510 | 1/1992 |
| DE | 42 21 381 | 7/1992 |
| DE | 43 00 772 | 1/1993 |
| DE | 43 03 320 | 2/1993 |
| DE | 44 00 024 | 1/1994 |
| DE | 44 16 438 | 5/1994 |
| DE | 44 17 734 | 5/1994 |
| DE | 44 43 177 | 12/1994 |
| DE | 195 24 287 | 7/1995 |
| DE | 195 29 905 | 8/1995 |
| DE | 195 36 082 | 9/1995 |
| DE | 195 47 457 | 12/1995 |
| DE | 196 00 018 | 1/1996 |
| DE | 196 05 688 | 2/1996 |
| DE | 196 13 103 | 4/1996 |
| DE | 196 16 693 | 4/1996 |
| DE | 196 16 767 | 4/1996 |
| DE | 196 16 769 | 4/1996 |
| DE | 196 16 770 | 4/1996 |
| DE | 196 20 411 | 4/1996 |
| DE | 196 20 267 | 5/1996 |
| DE | 197 09 991 | 3/1997 |
| DE | 197 10 254 | 3/1997 |

(Continued)

OTHER PUBLICATIONS

J. Falbe, "Surfactants in Consumer Products", pp. 54-125, Springer Verlag, Berlin, 1987.

(Continued)

*Primary Examiner*—Lorna M. Douyon
(74) *Attorney, Agent, or Firm*—John F. Daniels; Daniel S. Ortiz

(57) ABSTRACT

A detergent composition containing: (a) an anionic surfactant selected from the group consisting of an alkylbenzenesulfonate, an alkyl sulfate, a soap, an alkanesulfonate, an olefinsulfonate, a methyl ester sulfonate, and mixtures thereof; (b) a non-enzymatic protein and/or derivative thereof; (c) a phosphate; (d) a disintegrating agent; an (e) optionally, a co-surfactant selected from the group consisting of a nonionic surfactant, an amphoteric surfactant, and mixtures thereof, and wherein the detergent composition is in a solid form.

20 Claims, No Drawings

FOREIGN PATENT DOCUMENTS

| | | |
|---|---|---|
| EP | 0 028 432 | 10/1980 |
| EP | 0 150 930 | 1/1985 |
| EP | 0 232 202 | 1/1987 |
| EP | 0 272 030 | 12/1987 |
| EP | 0 309 931 | 9/1988 |
| EP | 0 392 592 | 4/1989 |
| EP | 0 026 529 | 9/1990 |
| EP | 0 427 349 | 11/1990 |
| EP | 0 443 651 | 2/1991 |
| EP | 0 446 982 | 2/1991 |
| EP | 0 453 003 | 2/1991 |
| EP | 0 458 397 | 5/1991 |
| EP | 0 458 398 | 5/1991 |
| EP | 0 525 239 | 7/1991 |
| EP | 0 472 042 | 8/1991 |
| EP | 0 542 496 | 11/1992 |
| EP | 0 544 490 | 11/1992 |
| EP | 0 544 519 | 11/1992 |
| EP | 0 549 271 | 12/1992 |
| EP | 0 549 272 | 12/1992 |
| EP | 0 693 550 | 7/1995 |
| EP | 0 703 292 | 9/1995 |
| FR | 2 147 443 | 3/1973 |
| GB | 1 529 841 | 10/1978 |
| GB | 1 536 136 | 12/1978 |
| GB | 94 19 091 | 8/1988 |
| GB | 2 242 130 | 9/1991 |
| GB | 2 327 949 | 2/1999 |
| JP | 5339896 | 12/1993 |
| WO | WO 90/03977 | 9/1989 |
| WO | WO 93/08251 | 4/1991 |
| WO | WO 91/08171 | 6/1991 |
| WO | WO 92/18542 | 10/1992 |
| WO | WO 93/16110 | 8/1993 |
| WO | WO 94/27970 | 12/1994 |
| WO | WO 94/28030 | 12/1994 |
| WO | WO 94/28102 | 12/1994 |
| WO | WO 94/28103 | 12/1994 |
| WO | WO 95/00626 | 1/1995 |
| WO | WO 95/07303 | 3/1995 |
| WO | WO 95/12619 | 5/1995 |
| WO | WO 95/14075 | 5/1995 |
| WO | WO 95/14759 | 6/1995 |
| WO | WO 95/17498 | 6/1995 |
| WO | WO 95/20029 | 7/1995 |
| WO | WO 95/20608 | 8/1995 |
| WO | WO 95/27775 | 10/1995 |
| WO | WO 98/40462 | 2/1998 |
| WO | WO 98/40463 | 9/1998 |
| WO | WO 98/55583 | 12/1998 |
| WO | WO 98/55590 | 12/1998 |

OTHER PUBLICATIONS

J. Falbe et al., "Katalysatoren, Tenside und Mineralöladditive", Catalysts, Surfactants and Mineral Oil Additives pp. 123-217, Thieme Verlag. Stuttgart, 1978.

G. Schuster et al., "Fette und Öle Tenside Waschmittel", pp. 177-184, vol. 108, Seifen Öle Fette Wachse, (1982).

G. Schuster et al., "Protein Chemistry as Related to Cosmetics and Toiltries", pp 63-74, vol 99, Cosmetics & Toiletries, Dec. 1984.

H.W. Steisslinger, "Kollagen-Hydrolysate", pp 556-557, 560-561, 565-566, vol. 72, Parfümerie und Kosmetik (1991).

F. Aurich et al., "Enzymatisch hergestellte Proteinhydrolysate", pp 389-395, Tenside Surf. Det. 29 (1992) 6.

J. Falbe et al., *R ōmpp Chemie Lexikon*, pp. 4440, Georg Thieme Verlag Stuttgart (1992).

R.C. MacKenzie and B.D. Mitchell, "Differential Thermal Analysis", pp. 420-434, MacKenzie and Mitchell: Differential Thermal Analysis. A Review, vol. 87, (1962).

* cited by examiner

DETERGENT TABLETS

BACKGROUND OF THE INVENTION

The invention is in the field of shaped detergents and relates to tablets containing surfactants, builders and disintegrants and which additionally comprise, as hand modifiers, proteins or protein derivatives.

On the market detergents are available which not only clean the laundry, but also impart a particularly soft feel to it. Such preparations, which are often referred to as soft detergents, usually comprise, as hand modifiers, cationic surfactants of the tetraalkylammonium compound type, mostly in combination with phyllosilicates. Said quaternary ammonium compounds are unsatisfactory with regard to their biodegradability, and it is also known that laundry treated therewith can cause irritations in very sensitive users. In addition, combination with anionic surfactants readily leads to undesired salt formation. For this reason there is vigorous interest in replacements which are free from these disadvantages.

One solution would be to replace the quaternary ammonium compounds with other cationic surfactants of the ester quat type. Although these are to be regarded as being significantly better with regard to their ecotoxicological compatibility and have even manifoldly superior hand modifying properties, they are only hydrolysis-resistant to a limited extent under the alkaline conditions of the washing process and are thus unsuitable as a true replacement.

Consequently, the object of the present invention was to provide novel shaped detergents, preferably in the form of tablets, which no longer give any cause for complaint with regard to their ecotoxicological compatibility and which are readily soluble under washing conditions, exhibit adequate chemical stability and, in particular, give the laundry an excellent soft feel.

DESCRIPTION OF THE INVENTION

The invention provides detergent tablets comprising (a) anionic, nonionic and/or amphoteric surfactants, (b) nonenzymatic proteins and/or derivatives thereof, (c) phosphates and (d) disintegrants.

Surprisingly, it has been found that the detergent tablets according to the invention satisfy the requirements given at the beginning in an advantageous manner. The nonenzymatic proteins and protein derivatives represent ideal replacements for cationic surfactants since they effect comparable hand modification, but are also chemically stable under alkaline conditions and give no cause for complaint either from an ecological viewpoint or from a toxicological viewpoint. A particularly advantageous hand modifying effect is observed in particular in combination with phosphates as builders; this effect can be improved yet further by the addition of phyllosilicates and/or the use of a surfactant system based on alkylbenzenesulfonates and alkyl sulfates. The detergents are preferably free from cationic surfactants.

Surfactants

The detergents can comprise, as component (a), anionic, nonionic and/or amphoteric or zwitterionic surfactants; however, anionic surfactants or combinations of anionic and nonionic surfactants are preferably present. Typical examples of anionic surfactants are soaps, alkylbenzenesulfonates, alkanesulfonates, olefin-sulfonates, alkyl ether sulfonates, glycerol ether sulfonates, α-methyl ester sulfonates, sulfofatty acids, alkyl sulfates, fatty alcohol ether sulfates, glycerol ether sulfates, hydroxy mixed ether sulfates, monoglyceride (ether) sulfates, fatty acid amide (ether) sulfates, mono- and dialkyl sulfosuccinates, mono- and dialkyl sulfosuccinamates, sulfo-triglycerides, amide soaps, ethercarboxylic acids and salts thereof, fatty acid isethionates, fatty acid sarcosinates, fatty acid taurides, N-acylamino acids, such as, for example, acyl lactylates, acyl tartrates, acyl glutamates and acyl aspartates, alkyl oligoglucoside sulfates, protein fatty acid condensates (in particular vegetable products based on wheat) and alkyl (ether) phosphates. If the anionic surfactants comprise polyglycol ether chains, these may have a conventional homolog distribution, but preferably have a narrowed homolog distribution. Preference is given to using alkylbenzenesulfonates, alkyl sulfates, soaps, alkanesulfonates, olefinsulfonates, methyl ester sulfonates, and mixtures thereof.

Preferred alkylbenzenesulfonates preferably conform to the formula (I), $$R—Ph—SO_3X \quad (I)$$

in which R is a branched, but preferably linear, alkyl radical having 10 to 18 carbon atoms, Ph is a phenyl radical and X is an alkali metal and/or alkaline earth metal, ammonium, alkylammonium, alkanolammonium or glu-cammonium. Of these, dodecylbenzenesulfonates, tetra-decylbenzenesulfonates, hexadecylbenzenesulfonates, and the technical-grade mixtures thereof in the form of the sodium salts are particularly suitable.

Alkyl and/or alkenyl sulfates, which are also often referred to as fatty alcohol sulfates, are to be understood as meaning the sulfation products of primary and/or secondary alcohols which preferably conform to the formula (II)

$$R^2O—SO_3Y \quad (II)$$

in which $R^2$ is a linear or branched, aliphatic alkyl and/or alkenyl radical having 6 to 22, preferably 12 to 18, carbon atoms and Y is an alkali metal and/or alkaline earth metal, ammonium, alkylammonium, alkanolammonium or glu-cammonium. Typical examples of alkyl sulfates which can be used for the purposes of the invention are the sulfation products of caproic alcohol, caprylic alcohol, capric alcohol, 2-ethylhexyl alcohol, lauryl alcohol, myristyl alcohol, cetyl alcohol, palmoleyl alcohol, stearyl alcohol, isostearyl alcohol, oleyl alcohol, elaidyl alcohol, petroselinyl alcohol, arachidyl alcohol, gadoleyl alcohol, behenyl alcohol and erucyl alcohol, and the technical-grade mixtures thereof which are obtained by high-pressure hydrogenation of technical-grade methyl ester fractions or aldehydes from the Roelen oxosynthesis. The sulfation products can preferably be used in the form of their alkali metal salts and in particular their sodium salts. Particular preference is given to alkyl sulfates based on $C_{16/18}$-tallow fatty alcohols or vegetable fatty alcohols of comparable carbon chain distribution in the form of their sodium salts. Branched primary alcohols are oxo alcohols, as obtainable, for example, by reacting carbon monoxide and hydrogen at alpha-position olefins by the Shop process. Such alcohol mixtures are available commercially under the trade name Dobanol® or Neodol®. Suitable alcohol mixtures are Dobanol 91®, 23®, 25®, 45®. Another option is oxoalcohols as are obtained by the classical oxo process by Enichema or by Condea by the addition of carbon monoxide and hydrogen onto olefins. These alcohol mixtures are a mixture of greatly branched alcohols. Such alcohol mixtures are available commercially under the trade name Lial®. Suitable alcohol mixtures are Lial 91®, 111®, 123®, 125®, 145®.

Soaps are to be understood finally as meaning fatty acid salts of the formula (III)

$$R^3CO—OX \quad (III)$$

in which $R^3CO$ is a linear or branched, saturated or unsaturated acyl radical having 6 to 22 and preferably 12 to 18 carbon atoms and X is an alkali metal and/or alkaline earth metal, ammonium, alkylammonium or alkanolammonium. Typical examples are the sodium, potassium, magnesium, ammonium and triethanolammonium salts of caproic acid, caprylic acid, 2-ethylhexanoic acid, capric acid, lauric acid, isotridecanoic acid, myristic acid, palmitic acid, palmoleic acid, stearic acid, isostearic acid, oleic acid, elaidic acid, petroselic acid, linoleic acid, linolenic acid, elaeostearic acid, arachidic acid, gadoleic acid, behenic acid and erucic acid, and the technical-grade mixtures thereof. Preference is given to using coconut or palm kernel fatty acid in the form of its sodium or potassium salts.

Typical examples of nonionic surfactants are fatty alcohol polyglycol ethers, alkylphenol polyglycol ethers, fatty acid polyglycol esters, fatty acid amide polyglycol ethers, fatty amine polyglycol ethers, alkoxylated triglycerides, mixed ethers or mixed formals, alk(en)yl oligoglycosides, fatty acid N-alkylglucamides, protein hydrolyzates (in particular vegetable products based on wheat), polyol fatty acid esters, sugar esters, sorbitan esters, polysorbates and amine oxides. If the nonionic surfactants contain polyglycol ether chains, these can have a conventional homolog distribution, but preferably have a narrowed homolog distribution. Preference is given to using fatty alcohol polyglycol ethers, alkoxylated fatty acid lower alkyl esters or alkyl oligoglucosides.

The preferred fatty alcohol polyglycol ethers conform to the formula (IV), $$R^4O(CH_2CHR^5O)_nH \quad (IV)$$

in which $R^4$ is a linear or branched alkyl and/or alkenyl radical having 6 to 22, preferably 12 to 18, carbon atoms, $R^5$ is hydrogen or methyl and n is numbers from 1 to 20. Typical examples are the addition products of, on average, 1 to 20 and preferably 5 to 10, mol of ethylene oxide and/or propylene oxide onto caproic alcohol, caprylic alcohol, 2-ethylhexyl alcohol, capric alcohol, lauryl alcohol, isotridecyl alcohol, myristyl alcohol, cetyl alcohol, palmoleyl alcohol, stearyl alcohol, isostearyl alcohol, oleyl alcohol, elaidyl alcohol, petroselinyl alcohol, linolyl alcohol, linolenyl alcohol, elaeostearyl alcohol, arachidyl alcohol, gadoleyl alcohol, behenyl alcohol, erucyl alcohol and brassidyl alcohol, and the technical-grade mixtures thereof. Particular preference is given to the addition products of 3, 5 or 7 mol of ethylene oxide onto technical-grade coconut fatty alcohols.

Suitable alkoxylated fatty acid lower alkyl esters are surfactants of the formula (V)

$$R^6CO—(OCH_2CHR^7)_mOR^8 \quad (V)$$

in which $R^6CO$ is a linear or branched, saturated and/or unsaturated acyl radical having 6 to 22 carbon atoms, $R^7$ is hydrogen or methyl, $R^8$ is linear or branched alkyl radicals having 1 to 4 carbon atoms and m is numbers from 1 to 20. Typical examples are the formal insertion products of, on average, 1 to 20 and preferably 5 to 10 mol of ethylene oxide and/or propylene oxide into the methyl, ethyl, propyl, isopropyl, butyl and tert-butyl esters of caproic acid, caprylic acid, 2-ethylhexanoic acid, capric acid, lauric acid, isotridecanoic acid, myristic acid, palmitic acid, palmoleic acid, stearic acid, isostearic acid, oleic acid, elaidic acid, petroselic acid, linoleic acid, linolenic acid, elaeostearic acid, arachidic acid, gadoleic acid, behenic acid and erucic acid, and the technical-grade mixtures thereof. The products are usually prepared by inserting the alkylene oxides into the carbonyl ester bond in the presence of specific catalysts, such as, for example, calcined hydrotalcite. Particular preference is given to the reaction products of, on average, 5 to 10 mol of ethylene oxide into the ester bond of technical-grade coconut fatty acid methyl esters.

Alkyl and alkenyl oligoglycosides, which are also preferred nonionic surfactants, usually conform to the formula (VI)

$$R^9O—[G]_p \quad (VI)$$

in which $R^9$ is an alkyl and/or alkenyl radical having 4 to 22 carbon atoms, G is a sugar radical having 5 or 6 carbon atoms and p is numbers from 1 to 10. They can be obtained by relevant methods of preparative organic chemistry. As a representative of the extensive literature, reference may be made here to the specifications EP-AL 0 301 298 and WO 90/03977. The alkyl and/or alkenyl oligoglycosides can be derived from aldoses or ketoses having 5 or 6 carbon atoms, preferably from glucose. The preferred alkyl and/or alkenyl oligoglycosides are thus alkyl and/or alkenyl oligoglucosides. The index number p in the general formula (VI) gives the degree of oligomerization (DP), i.e. the distribution of mono- and oligoglycosides and is a number between 1 and 10. While p in a given compound must always be a whole number and here can primarily assume the values p=1 to 6, the p for a certain alkyl oligoglycoside is an analytically determined calculated parameter which in most cases is a fraction. Preference is given to using alkyl and/or alkenyl oligoglycosides with an average degree of oligomerization p of from 1.1 to 3.0. From a performance viewpoint, preference is given to those alkyl and/or alkenyl oligoglycosides whose degree of oligomerization is less than 1.7 and is in particular between 1.2 and 1.4. The alkyl or alkenyl radical $R^9$ can be derived from primary alcohols having 4 to 11, preferably 8 to 10, carbon atoms. Typical examples of butanol, caproic alcohol, caprylic alcohol, capric alcohol and undecyl alcohol, and the technical-grade mixtures thereof, as are obtained, for example, in the hydrogenation of technical-grade fatty acid methyl esters or in the course of the hydrogenation of aldehydes from the Roelen oxo synthesis. Preference is given to alkyl oligoglucosides of chain length $C_8$–$C_{10}$ (DP=1 to 3), which form as forerunnings in the distillative separation of technical-grade $C_8$–$C_{18}$-coconut fatty alcohol and can be contaminated with a proportion of less than 6% by weight of $C_{12}$-alcohol, and also alkyl oligoglucosides based on technical-grade $C_{9/11}$-oxo alcohols (DP=1 to 3). The alkyl or alkenyl radical $R^9$ can also be derived from primary alcohols having 12 to 22, preferably 12 to 14, carbon atoms. Typical examples are lauryl alcohol, myristyl alcohol, cetyl alcohol, palmoleyl alcohol, stearyl alcohol, isostearyl alcohol, oleyl alcohol, elaidyl alcohol, petroselinyl alcohol, arachidyl alcohol, gadoleyl alcohol, behenyl alcohol, erucyl alcohol, brassidyl alcohol, and the technical-grade mixtures thereof which can be obtained as described above. Preference is given to alkyl oligoglucosides based on hydrogenated $C_{12/14}$ -coconut alcohol with a DP of from 1 to 3.

Typical examples of amphoteric or zwitterionic surfactants are alkylbetaines, alkylamidobetaines, aminopropionates, aminoglycinates, imidazolinium-betaines and sulfobetaines. Said surfactants are all known compounds. With regard to the structure and preparation of these substances, reference is made to the relevant overview works, for example J. Falbe (ed.), "Surfactants in Consumer Products", Springer Verlag, Berlin, 1987, pp. 54–124 or J. Falbe (ed.), "Katalysatoren, Tenside und Mineralöladditive", Thieme Verlag, Stuttgart, 1978, pp. 123–217. The detergents can comprise the surfactants in amounts of from 1 to 50% by weight, preferably 5 to 25% by weight and in particular 10 to 20% by weight, based on the detergents.

Nonenzymatic Proteins and Derivatives Thereof

Nonenzymatic proteins and derivatives thereof (component b), which are preferably protein hydrolyzates and/or protein fatty acid condensates, are known substances which are used, for example, in skincare compositions [cf. Seifen-Fette-Ole-Wachse, 108, 177 (1982)]. The addition "nonenzymatic" has been chosen in order to differentiate the substances from typical detergent enzymes which are not used for the purpose of the invention. Typical examples of nonenzymatic proteins which can be used in the compositions according to the invention are keratin, elastin, collagen, wheat proteins, milk proteins, eggwhite proteins, silk proteins, almond proteins, soybean proteins and other cereal proteins, and proteins from animal skins. Protein hydrolyzates are degradation products of these animal or vegetable proteins which are cleaved by acidic, alkaline and/or enzymatic hydrolysis and then have an average molecular weight in the range from 600 to 4 000, preferably 2 000 to 3 500. Although protein hydrolyzates are not surfactants in the classical sense because they lack a hydrophobic radical, they are often widely used for formulating surface-active compositions because of their dispersing properties. Overviews relating to the preparation and use of protein hydrolyzates are given, for example, by G. Schuster and A. Domsch in Seifen Ole Fette Wachse, 108, 177 (1982) and Cosm. Toil. 99, 63 (1984), by H. W. Steisslinger in Parf. Kosm. 72, 556 (1991) and F. Aurich et al. in Tens. Surf. Det. 29, 389 (1992). Reacting said protein hydrolyzates with fatty acids which generally contain 6 to 22 and preferably 12 to 18 carbon atoms in the acyl radical gives protein fatty acid condensates. The condensates are usually used in the form of their alkali metal, alkaline earth metal, ammonium, alkyl ammonium or alkanol ammonium salts. Typical examples are the condensation products of wheat or soybean protein hydrolyzates with caproic acid, caprylic acid, 2-ethylhexanoic acid, capric acid, lauric acid, isotridecanoic acid, myristic acid, palmitic acid, palmoleic acid, stearic acid, isostearic acid, oleic acid, elaidic acid, petroselic acid, linoleic acid, linolenic acid, elaeostearic acid, arachidic acid, gadoleic acid, behenic acid and erucic acid, and the technical-grade mixtures thereof. The compositions according to the invention can comprise the proteins and protein derivatives in amounts of from 0.1 to 10% by weight, preferably 1 to 8% by weight and in particular 3 to 5% by weight, based on the compositions.

Phosphates

The detergent tablets according to the invention comprise phosphates as builders (component c). The sodium salts of orthophosphaLes, of pyrophospliates and in particular of tripolyphosphates are particularly suitable. In some cases, it has been found that, in particular tripolyphosphates, even in small amounts up to at most 10% by weight, based on the finished composition, in combination with other builder substances lead to a synergistic improvement in the secondary detergency. The phosphates are present in the final preparations preferably in amounts of from 10 to 60% by weight, in particular 15 to 25% by weight, based on the compositions.

Disintegrants

The term disintegrants (component d) is to be understood as meaning substances which are added to the moldings in order to accelerate their disintegration when brought into contact with water. Overviews relating to this are given, for example, in J. Pharm. Sci. 61 (1972) or Römpp Chemilexikon, 9th edition, Volume 6, p. 4440. The disintegrants may, when viewed macroscopically, be present in homogeneous distribution within the molding, although when viewed microscopically they form zones of increased concentration as a result of the preparation. Preferred disintegrants include polysaccharides, such as, for example, natural starch and derivatives thereof (carboxymethyl starch, starch glycolates in the form of their alkali metal salts, agar agar, guar gum, pectins etc.), celluloses and derivatives thereof (carboxymethylcellulose, microcrystalline cellulose), polyvinylpyrrolidone, collidone, alginic acid and alkali metal salts thereof, amorphous or else partially crystalline phyllosilicates (bentonites), polyurethanes, polyethylene glycols, and gas-generating systems. Further disintegrants which may be present for the purposes of the invention are, for example, given in the publications WO 98/40462 (Rettenmeyer), WO 98/55583 and WO 98/55590 (Unilever) and WO 98/40463, DE 19709991 and DE 19710254 (Henkel). Reference is expressly made to the teaching of these specifications. The moldings can comprise the disintegrants in amounts of from 0.1 to 25% by weight, preferably 1 to 20% by weight and in particular 5 to 15% by weight, based on the moldings.

Auxiliaries and Additives

Further preferred ingredients of the detergents according to the invention are additional inorganic or organic builder substances, the inorganic builder substances used mainly being zeolites, crystalline phyllosilicates or amorphous silicates with builder properties. The amount of cobuilder is to be counted toward the preferred amounts of phosphates.

The finely crystalline, synthetic zeolite which contains bonded water and is often used as detergent builder is preferably zeolite A and/or P. As zeolite P, particular preference is given, for example, to zeolite MAP® (commercial product from Crosfield). Also suitable, however, are zeolite X, and mixtures of A, X and/or P and also Y. Also of particular interest is a cocrystallized sodium/potassium aluminum silicate of zeolite A and zeolite X, which is available commercially as VEGOBOND AX® (commercial product from Condea Augusta S.p.A.). The zeolite can be used as a spray-dried powder or else as an undried stabilized suspension still damp from its preparation. Where the zeolite is used as suspension, it may comprise small additions of nonionic surfactants as stabilizers, for example 1 to 3% by weight, based on zeolite, of ethoxylated $C_{12}$–$C_{18}$-fatty alcohols having 2 to 5 ethylene oxide groups, $C_{12}$–$C_{14}$-fatty alcohols having 4 to 5 ethylene oxide groups or ethoxylated isotridecanols. Suitable zeolites have an average particle size of less than 10 $\mu$m (volume distribution; measurement method: Coulter counter) and preferably comprise 18 to 22% by weight, in particular 20 to 22% by weight, of bonded water.

Suitable substitutes or partial substitutes for phosphates and zeolites are crystalline, layered sodium silicates of the general formula $NaMSi_xO_{2x+1}\cdot yH_2O$, where M is sodium or hydrogen, x is a number from 1.9 to 4 and y is a number from 0 to 20 and preferred values for x are 2, 3 or 4. Such crystalline phyllosilicates are described, for example, in European patent application EP 0164514 A1. Preferred crystalline phyllosilicates of the given formula are those in which M is sodium and x assumes the values 2 or 3. In particular, both β- and also δ-sodium disilicates $Na_2Si_2O_5 \cdot yH_2O$ are preferred, β-sodium disilicate being obtained, for example, by the process described in international patent application WO 91/08171. Further suitable phyllosilicates are known, for example, from patent applications DE 2334899 A1, EP 0026529 A1 and DE 3526405 A1. Their applicability is not limited to a specific composition or structural formula. However, preference is given here to smectites, in particular bentonites. Suitable phyllosilicates which belong to the group of water-swellable smectites are, for example, those of the general formulae $(OH)_4Si_{8-y}Al_y(Mg_xAl_{4-x})O_{20}$ montmorillonite $(OH)_4Si_{8-y}Al_y(Mg_{6-z}Li_z)O_{20}$ hectorite $(OH)_4Si_{8-y}Al_y(Mg_{6-z}Al_z)O_{20}$ saponite where x=0 to 4, y=0 to 2, z=0 to 6. In addition, small amounts of iron can be incorporated into the crystal lattice of the phyllosilicates according to the above formulae. In addition, the phyllosilicates can, on the basis of their ion exchanging properties, contain hydrogen ions, alkali metal ions, alkaline earth metal ions, in particular $Na^+$and Ca 2+. The amount of water of hydration is in most cases in the range from 8 to 20% by weight and is dependent on the swelling state or on the type of processing. Phyllosilicates which can be used are known, for example, from U.S. Pat. No. 3,966,629, U.S. Pat. No. 4,062,647, EP 0026529 A1 and EP 0028432 A1. Preference is given to using phyllosilicates which, because of an alkali treatment, are largely free from calcium ions and deeply coloring iron ions.

Preferred builder substances also include amorphous sodium silicates with an $Na_2O:SiO_2$ modulus of 1:2 to 1:3.3, preferably from 1:2 to 1:2.8 and in particular from 1:2 to 1:2.6, which have delayed dissolution and secondary detergency properties. The dissolution delay relative to conventional amorphous sodium silicates can have been induced by various means, for example by surface treatment, compounding, compacting/consolidation or by overdrying. For the purposes of this invention, the term "amorphous" is also understood as meaning "X-ray amorphous". This means that, in X-ray diffraction experiments, the silicates do not give sharp X-ray reflections typical of crystalline substances, but instead, at best, one or more maxima of the scattered X-rays having a breadth of several degree units of the diffraction angle. However, particularly good builder properties may result even if the silicate particles give poorly defined or even sharp diffraction maxima in electron diffraction experiments. This is to be interpreted to the effect that the products have microcrystalline regions with a size from 10 to a few hundred nm, preference being given to values up to at most 50 nm and in particular up to at most 20 nm. Such X-ray amorphous silicates which likewise have delayed dissolution relative to conventional waterglasses are described, for example, in German patent application DE 4400024 A1. Particular preference is given to consolidated/compacted amorphous silicates, compounded amorphous silicates and overdried X-ray amorphous silicates.

Organic builder substances which can be used are, for example, the polycarboxylic acids which can be used in the form of their sodium salts, such as citric acid, adipic acid, succinic acid, glutaric acid, tartaric acid, sugar acids, aminocarboxylic acids, nitrilo-triacetic acid (NTA), provided such a use is not objectionable on ecological grounds, and mixtures thereof. Preferred salts are the salts of polycarboxylic acids, such as citric acid, adipic acid, succinic acid, glutaric acid, tartaric acid, sugar acids and mixtures thereof. The acids can also be used per se. In addition to their builder action, the acids typically also have the property of an acidification component and thus also serve to establish a lower and milder pH of laundry detergents or cleaning compositions. In this connection, citric acid, succinic acid, glutaric acid, adipic acid, gluconic acid and any mixtures thereof are to be mentioned in particular.

Other suitable organic builder substances are dextrins, for example oligomers or polymers of carbohydrates which can be obtained by partial hydrolysis of starches. The hydrolysis can be carried out by customary processes, for example acid-catalyzed or enzyme-catalyzed processes. The hydrolysis products preferably have average molar masses in the range from 400 to 500 000. Preference is given here to a polysaccharide with a dextrose equivalent (DE) in the range from 0.5 to 40, in particular from 2 to 30, where DE is a common measure of the reducing effect of a polysaccharide compared with dextrose, which has a DE of 100. It is possible to use maltodextrins having a DE between 3 and 20 and dried glucose syrups having a DE between 20 and 37, and also yellow dextrins and white dextrins with higher molar masses in the range from 2 000 to 30 000. A preferred dextrin is described in British patent application GB 9419091 A1. The oxidized derivatives of such dextrins are their reaction products with oxidizing agents which are able to oxidize at least one alcohol function of the saccharide ring to give the carboxylic acid function. Such oxidized dextrins and processes for their preparation are known, for example, from European patent applications EP 0232202 A1, EP 0427349 A1, EP 0472042 A1 and EP 0542496 A1, and international patent applications WO 92/18542, WO 93/08251, WO 93/16110, WO 94/28030, WO 95/07303, WO 95/12619 and WO 95/20608. Also suitable is an oxidized oligo-saccharide according to German patent application DE 19600018 A1. A product oxidized on $C_6$ of the saccharide ring may be particularly advantageous.

Further suitable cobuilders are oxydisuccinates and other derivatives of disuccinates, preferably ethylenediamine disuccinate. Particular preference is also given in this connection to glycerol disuccinates and glycerol trisuccinates, as are described, for example, in American patent specifications U.S. Pat. No. 4,524,009, U.S. Pat. No. 4,639,325, in European patent application EP 0150930 A1 and Japanese patent application JP 93/339896. Suitable use amounts in zeolite-containing and/or silicate-containing formulations are 3 to 15% by weight.

Further organic cobuilders which can be used are, for example, acetylated hydroxycarboxylic acids or salts thereof, which may also be present in lactone form and which contain at least 4 carbon atoms and at least one hydroxyl group and at most two acid groups. Such cobuilders are described, for example, in international patent application WO 95/20029.

Suitable polymeric polycarboxylates are, for example, the sodium salts of polyacrylic acid or of polymethacrylic acid, for example those with a relative molecular mass of from 800 to 150 000 (based on acid and in each case measured against polystyrenesulfonic acid). Suitable copolymeric polycarboxylates are, in particular, those of acrylic acid with methacrylic acid and of acrylic acid or methacrylic acid with maleic acid. Copolymers which have proven particularly suitable are those of acrylic acid with maleic acid which comprise 50 to 90% by weight of acrylic acid and 50 to 10% by weight of maleic acid. Their relative molecular mass, based on free acids, is generally 5 000 to 200 000, preferably 10 000 to 120 000 and in particular 50 000 to 100 000 (in each case measured against polystyrenesulfonic acid). The (co)polymeric polycarboxylates can either be used as powders or as aqueous solution, 20 to 55% strength by weight aqueous solutions being preferred. Granular polymers are in most cases subsequently mixed into one or more base granulates. Particular preference is also given to biodegradable polymers of more than two different monomer units, for example those which, according to DE 4300772 A1, contain, as monomers, salts of acrylic acid and of maleic acid, and vinyl alcohol or vinyl alcohol derivatives or, according to DE 4221381 C2, contain, as monomers, salts of acrylic acid and of 2-alkylallylsulfonic acid, and sugar derivatives. Further preferred copolymers are those described in German patent applications DE 4303320 A1 and DE 4417734 A1 and have, as monomers, preferably acrolein and acrylic acid/acrylic acid salts or acrolein and vinyl acetate. Likewise to be mentioned as further preferred builder substances are polymeric aminodicarboxylic acids, salts thereof or precursor substances thereof. Particular preference is given to polyaspartic acids or salts and derivatives thereof.

Further suitable builder substances are polyacetals which can be obtained by reacting dialdehydes with polyolcarboxylic acids which have 5 to 7 carbon atoms and at least 3 hydroxyl groups, for example as described in European patent application EP 0280223 A1. Preferred polyacetals are obtained from dialdehydes such as glyoxal, glutaraldehyde, terephthalaldehyde, and mixtures thereof and from polyolcarboxylic acids such as gluconic acid and/or glucoheptonic acid.

In addition, the compositions can also comprise components which have a positive influence on the ability of oil and grease to be washed out of textiles. Preferred oil- and grease-dissolving components include, for example, nonionic cellulose ethers, such as methyl cellulose and methylhydroxypropyl cellulose with a proportion of methoxy groups of from 15 to 30% by weight and of hydroxypropoxy groups of from 1 to 15% by weight, in each case based on the nonionic cellulose ethers, and the polymers, known from prior art, of phthalic acid and/or of terephthalic acid or of derivatives thereof, in particular polymers of ethylene terephthalates and/or polyethylene glycol terephthalates or anionically and/or nonionically modified derivatives thereof. Of these, particular preference is given to the sulfonated derivatives of phthalic acid polymers and of terephthalic acid polymers.

Further suitable ingredients of the compositions are water-soluble inorganic salts, such as bicarbonates, carbonates, amorphous silicates, normal waterglasses which do not have any outstanding builder properties, or mixtures thereof; in particular, use is made of alkali metal carbonate and/or amorphous alkali metal silicate, especially sodium silicate with an $Na_2O:SiO_2$ molar ratio of from 1:1 to 1:4.5, preferably from 1:2 to 1:3.5. The content of sodium carbonate in the final preparations is here preferably up to 40% by weight, advantageously between 2 and 35% by weight. The content of sodium silicate (without particular builder properties) in the compositions is generally up to 10% by weight and preferably between 1 and 8% by weight.

Apart from said ingredients, the compositions can comprise further known additives, for example salts of polyphosphonic acids, optical brighteners, enzymes, enzyme stabilizers, antifoams, small amounts of neutral filling salts and dyes and fragrances and the like.

Of the compounds which give off $H_2O_2$ in water and serve as bleaches, sodium perborate tetrahydrate and sodium perborate monohydrate are of particular importance. Further bleaches which can be used are, for example, sodium percarbonate, peroxypyrophosphates, citrate perhydrates, and $H_2O_2$-supplying peracidic salts or peracids, such as perbenzoates, peroxophthalates, diperazelaic acid, phthaloiminoperacid or diperdo-decanedioic acid. The content of bleaches in the compositions is preferably 5 to 35% by weight and in particular up to 30% by weight, preference being given to using perborate monohydrate or percarbonate.

Bleach activators which can be used are compounds which, under perhydrolysis conditions, release aliphatic peroxocarboxylic acids having preferably 1 to 10 carbon atoms, in particular 2 to 4 carbon atoms, and/or optionally substituted perbenzoic acid. Suitable substances are those which carry O- and/or N-acyl groups of said carbon atom number and/or optionally substituted benzoyl groups. Preference is given to polyacylated alkylenediamines, in particular tetraacetylethylenediamine (TAED), acylated triazine derivatives, in particular 1,5-diacetyl-2,4-dioxo-hexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), carboxylic anhydrides, in particular phthalic anhydride, acylated polyhydric alcohols, in particular triacetin, ethylene glycol diacetate, 2,5-diacetoxy-2,5-dihydrofuran and the enol esters known from German patent applications DE 19616693 A1 and DE 19616767 A1, and acetylated sorbitol and mannitol, or mixtures thereof described in European patent application EP 0525239 A1 (SORMAN), acylated sugar derivatives, in particular pentaacetyl glucose (PAG), pentaacetylfructose, tetraacetylxylose and octaacetyl-lactose, and acylated, optionally N-alkylated glucamine and gluconolactone, and/or N-acylated lactams, for example N-benzoylcaprolactam, which are known from international patent applications WO 94/27970, WO 94/28102, WO 94/28103, WO 95/00626, WO 95/14759 and WO 95/17498. The hydrophilically substituted acylacetals known from German patent application DE 19616769 A1, and the acyllactams described in German patent application DE 196 16 770 and international patent application WO 95/14075 are likewise used in preference. It is also possible to use the combinations of conventional bleach activators known from German patent application DE 4443177 A1. Such bleach activators are present in the customary quantitative range, preferably in amounts of from 1% by weight to 10% by weight, in particular 2% by weight to 8% by weight, based on the overall composition. In addition to the above conventional bleach activators or instead of them, the sulfonimines and/or bleach-boosting transition metal salts or transition metal complexes known from European patent specifications EP 0446982 B1 and EP 0453 003 B1 may also be present as what are known as bleach catalysts. Suitable transition metal compounds include, in particular, the manganese, iron, cobalt, ruthenium or molybdenum-salen complexes known from German patent application DE 19529905 A1 and their N-analogous compounds known from German patent application DE 19620267 A1, the manganese, iron, cobalt, ruthenium or molybdenum carbonyl complexes known from German patent application DE 19536082 A1, the manganese, iron, cobalt, ruthenium, molybdenum, titanium, vanadium and copper complexes with nitrogen-containing tripod ligands described in German patent application DE 196 05 688, the cobalt, iron, copper and ruthenium amine complexes known from German patent application DE 19620411 A1, the manganese, copper and cobalt complexes described in German patent application DE 4416438 A1, the cobalt complexes described in European patent application EP 0272030 A1, the manganese complexes known from European patent application EP 0693550 A1, the manganese, iron, cobalt and copper complexes known from European patent specification EP 0392592 A1 and/or the manganese complexes described in European patent specification EP 0443651 B1 or European patent applications EP 0458397 A1, EP 0458398 A1, EP 0549271 A1, EP 0549272 A1, EP 0544490 A1 and EP 0544519 A1. Combinations of bleach activators and transition metal bleach catalysts are known, for example, from German patent application DE 19613103 A1 and international patent application WO 95/27775. Bleach-boosting transition metal complexes, in particular those with the central atoms Mn, Fe, Co, Cu, Me, V, Ti and/or Ru, are used in customary amounts, preferably in an amount up to 1% by weight, in particular from 0.0025% by weight to 0.25% by weight and particularly preferably from 0.01% by weight to 0.1% by weight, in each case based on the overall composition.

Suitable enzymes are, in particular, those from the class of hydrolases, such as proteases, esterases, lipases and lipolytic enzymes, amylases, cellulases or other glycosyl hydrolases and mixtures of said enzymes. During washing, all of these hydrolases contribute to the removal of marks, such as protein-, grease- or starch-containing marks, and grayness. Cellulases and other glycosyl hydrolases may, by removing pilling and microfibrils, contribute to color retention and to an increase in the softness of the textile. For bleaching or for inhibiting color transfer it is also possible to use oxidoreductases. Particularly suitable enzymatic active ingredients are those obtained from bacterial strains or fungi, such as *Bacillus subtilis, Bacillus licheniformis, Streptomyces griseus* and *Humicola insolens*. Preference is given to using proteases of the Subtilisin type and in particular proteases obtained from *Bacillus lentus*. Of particular interest in this connection are enzyme mixtures, for example of protease and amylase or protease and lipase or lipolytic enzymes or protease and cellulase, or mixtures of cellulase and lipase or lipolytic enzymes or mixtures of protease, amylase and lipase or lipolytic enzymes or protease, lipase or lipolytic enzymes and cellulose, but in particular protease and/or lipase-containing mixtures or mixtures containing lipolytic enzymes. Examples of such lipolytic enzymes are the known cutinases. Peroxidases or oxidases have in some cases proven to be suitable. Suitable amylases include, in particular, α-amylases, isoamylases, pullulanases and pectinases. The cellulases used are preferably cellobiohydrolases, endoglucanases and β-glucosidases, which are also called cellobiases, or mixtures thereof. Since the different cellulase types differ in their CMCase and avicelase activities, it is possible to establish the desired activities through targeted mixtures of the cellulases. The enzymes can be adsorbed to carrier substances or embedded in coating substances in order to protect them from premature decomposition. The proportion of enzymes, enzyme mixtures or enzyme granules can, for example, be from about 0.1 to 5% by weight, preferably 0.1 to about 2% by weight.

In addition to the mono- and polyfunctional alcohols, the compositions can comprise further enzyme stabilizers. For example, 0.5 to 1% by weight of sodium formate can be used. Also possible is the use of proteases which have been stabilized with soluble calcium salts and a calcium content of, preferably, about 1.2% by weight, based on the enzyme. Apart from calcium salts, magnesium salts also serve as stabilizers. However, the use of boron compounds, for example of boric acid, boron oxide, borax and other alkali metal borates, such as the salts of orthoboric acid ($H_3BO_3$), of metaboric acid ($HBO_2$) and of pyroboric acid (tetraboric acid $H_2B_4O_7$), is particularly advantageous. Graying inhibitors have the task of keeping the soil detached from fibers suspended in the liquor, thus preventing soil reattachment. Suitable for this purpose are water-soluble colloids, mostly of an organic nature, for example the water-soluble salts of polymeric carboxylic acids, glue, gelatin, salts of ethercarboxylic acids or ethersulfonic acids of starch or of cellulose or salts of acidic sulfuric esters of cellulose or of starch. Water-soluble polyamides which contain acidic groups are suitable for this purpose. In addition, it is possible to use soluble starch preparations, and starch products other than those mentioned above, e.g. degraded starch, aldehyde starches, etc. It is also possible to use polyvinylpyrrolidone. Preference is, however, given to using cellulose ethers, such as carboxymethylcellulose (Na salt), methylcellulose, hydroxyalkylcellulose and mixed ethers, such as methylhydroxyethylcellulose, methylhydroxypropylcellulose, methylcarboxymethylcellulose and mixtures thereof, and polyvinylpyrrolidone, for example in amounts of from 0.1 to 5% by weight, based on the compositions.

The compositions can comprise, as optical brighteners, derivatives of diaminostilbenedisulfonic acid or the alkali metal salts thereof. Suitable compounds are, for example, salts of 4,4'-bis(2-anilino-4-morpholino-1,3,5-triazinyl-6-amino)stilbene-2,2'-disulfonic acid or compounds of similar structure which carry a diethanolamino group, a methylamino group, an anilino group or a 2-methoxyethylamino group instead of the morpholino group. Furthermore, brighteners of the substituted diphenylstyryl type may be present, e.g. the alkali metal salts of 4,4'-bis(2-sulfostyryl)-diphenyl, 4,4'-bis(4-chloro-3-sulfostyryl)diphenyl or 4-(4-chlorostyryl)-4'-(2-sulfostyryl)diphenyl. Mixtures of the above-mentioned brighteners can also be used. Uniformly white granulates are obtained if the compositions comprise, apart from the customary brighteners in customary amounts, for example between 0.1 and 0.5% by weight, preferably between 0.1 and 0.3% by weight, also small amounts, for example $10^{-6}$ to $10^{-3}$% by weight, preferably $10^{-5}$% by weight, of a blue dye. A particularly preferred dye is Tinolux®(D (commercial product from Ciba-Geigy).

Suitable soil release polymers (soil repellants) are those substances which preferably contain ethylene terephthalate and/or polyethylene glycol terephthalate groups, where the molar ratio of ethylene terephthalate to polyethylene glycol terephthalate may be in the range from 50:50 to 90:10. The molecular weight of the linking polyethylene glycol units is in particular in the range from 750 to 5 000, i.e. the degree of ethoxylation of polymers containing polyethylene glycol groups may be about 15 to 100. The polymers are characterized by an average molecular weight of about 5 000 to 200 000 and can have a block structure, but preferably have a random structure. Preferred polymers are those with ethylene terephthalate/polyethylene glycol terephthalate molar ratios of from about 65:35 to about 90:10, preferably from about 70:30 to 80:20. Preference is also given to those polymers which have linking polyethylene glycol units with a molecular weight of from 750 to 5 000, preferably from 1 000 to about 3 000 and a molecular weight of the polymers of from about 10 000 to about 50 000. Examples of commercially available polymers are the Milease® T products (ICI) or Repelotex® SRP 3 products (Rhone-Poulenc).

Antifoams which can be used are wax-like compounds. "Wax-like" compounds are to be understood as meaning those which have a melting point at atmospheric pressure above 25° C. (room temperature), preferably above 50° C. and in particular above 70° C. The wax-like antifoam substances are virtually insoluble in water, i.e. at 20° C. they have a solubility below 0.1% by weight in 100 g of water. In principle, all wax-like antifoam substances known from the prior art may be present. Suitable wax-like compounds are, for example, bisamides, fatty alcohols, fatty acids, carboxylic esters of mono- and polyhydric alcohols, and paraffin waxes or mixtures thereof. Alternatively, the silicone compounds known for this purpose can of course also be used.

Suitable paraffin waxes generally represent a complex mixture of substances without a sharp melting point. For characterization, its melting range is usually determined by differential thermoanalysis (DTA), as described in "The Analyst" 87 (1962), 420, and/or its solidification point. This is understood as meaning the temperature at which the paraffin converts from the liquid state to the solid state by slow cooling. In this connection, paraffins which are completely liquid at room temperature, i.e. those with a solidification point below 25° C., cannot be used according to the invention. It is possible, for example, to use the paraffin wax mixtures, known from EP 0309931 A1, comprising, for example, 26% by weight to 49% by weight of microcrystalline paraffin wax with a solidification point of from 62° C. to 90° C., 20% by weight to 49% by weight of hard paraffin with a solidification point of from 42° C. to 56° C. and 2% to 25% by weight of soft paraffin with a solidification point of from 35° C. to 40° C. Preference is given to using paraffins and paraffin mixtures which solidify in the range from 30° C. to 90° C. In this connection, it must be noted that paraffin wax mixtures which appear solid at room temperature may also comprise varying amounts of liquid paraffin.

In the paraffin waxes which can be used according to the invention, the liquid content is as low as possible or preferably is not present at all. Thus, particularly preferred paraffin wax mixtures have a liquid content of less than 10% by weight, in particular of from 2% by weight to 5% by weight, at 30° C., a liquid content of less than 30% by weight, preferably from 5% by weight to 25% by weight, and in particular from 5% by weight to 15% by weight at 40° C., a liquid content of from 30% by weight to 60% by weight, in particular from 40% by weight to 55% by weight at 60° C., a liquid content of from 80% by weight to 100% by weight at 80° C., and a liquid content of 100% by weight at 90° C. The temperature at which a liquid content of 100% by weight of the paraffin wax is achieved is still below 85° C., in particular 75° C. to 82° C. for particularly preferred paraffin wax mixtures. The paraffin waxes may be petrolatum, microcrystalline waxes or hydrogenated or partially hydrogenated paraffin waxes.

Suitable bisamides as antifoams are those derived from saturated fatty acids having 12 to 22, preferably 14 to 18 carbon atoms, and from alkylenediamines having 2 to 7 carbon atoms. Suitable fatty acids are lauric acid, myristic acid, stearic acid, arachidic acid and behenic acid, and mixtures thereof, as are obtainable from natural fats or hydrogenated oils, such as tallow or hydrogenated palm oil. Suitable diamines are, for example, ethylenediamine, 1,3-propylenediamine, tetramethylenediamine, pentamethylenediamine, hexamethylenediamine, p-phenylenediamine and tolylenediamine. Preferred diamines are ethylenediamine and hexamethylenediamine. Particularly preferred bisamides are bismyristoylethylenediamine, bispalmitoylethylenediamine, bisstearoylethylenediamine and mixtures thereof, and the corresponding derivatives of hexamethylenediamine.

Suitable carboxylic esters as antifoams are derived from carboxylic acids having 12 to 28 carbon atoms. In particular, the esters are of behenic acid, stearic acid, hydroxystearic acid, oleic acid, palmitic acid, myristic acid and/or lauric acid. The alcohol moiety of the carboxylic esters contains a mono- or polyhydric alcohol having 1 to 28 carbon atoms in the hydrocarbon chain. Examples of suitable alcohols are behenyl alcohol, arachidyl alcohol, coconut alcohol, 12-hydroxystearyl alcohol, oleyl alcohol and lauryl alcohol, and also ethylene glycol, glycerol, polyvinyl alcohol, sucrose, erythritol, pentaerythritol, sorbitan and/or sorbitol. Preferred esters are those of ethylene glycol, glycerol and sorbitan, where the acid moiety of the ester is chosen in particular from behenic acid, stearic acid, oleic acid, palmitic acid or myristic acid. Suitable esters of polyhydric alcohols are, for example, xylitol monopalmitate, pentaerythritol monostearate, glycerol monostearate, ethylene glycol monostearate and sorbitan monostearate, sorbitan palmitate, sorbitan monolaurate, sorbitan dilaurate, sorbitan distearate, sorbitan dibehenate, sorbitan dioleate, and mixed tallow alkyl sorbitan mono- and diesters. Glycerol esters which can be used are the mono-, di- or triesters of glycerol and said carboxylic acids, preference being given to the mono- or diesters. Glycerol monostearate, glycerol monooleate, glycerol monopalmitate, glycerol monobehenate and glycerol distearate are examples thereof. Examples of suitable natural esters as antifoams are beeswax, which consists primarily of the esters $CH_3(CH_2)_{24}COO(CH_2)_{27}CH_3$ and $CH_3(CH_2)_{26}COO(CH_2)_{25}CH_3$, and carnauba wax, which is a mixture of carnauba acid alkyl esters, often in combination with small fractions of free carnauba wax, further long-chain acids, high molecular weight alcohols and hydrocarbons.

Suitable carboxylic acids as further antifoam compound are, in particular, behenic acid, stearic acid, oleic acid, palmitic acid, myristic acid and lauric acid, and mixtures thereof, as are obtainable from natural fats or optionally hydrogenated oils, such as tallow or hydrogenated palm oil. Preference is given to saturated fatty acids having 12 to 22, in particular 18 to 22, carbon atoms.

Suitable fatty alcohols as further antifoam compound are the hydrogenated products of the fatty acids described.

In addition, dialkyl ethers may additionally be present as antifoams. The ethers can have an asymmetric structure, or else be symmetrical, i.e. contain two identical or different alkyl chains, preferably having 8 to 18 carbon atoms. Typical examples are di-n-octyl ether, di-i-octyl ether and di-n-stearyl ether, and particularly suitable dialkyl ethers are those which have a melting point above 25° C., in particular above 40° C.

Further suitable antifoam compounds are fatty ketones, which can be obtained by the relevant methods of preparative organic chemistry. They are prepared, for example, starting from carboxylic acid magnesium salts, which are pyrolyzed at temperatures above 300° C. with the elimination of carbon dioxide and water, for example in accordance with German laid-open specification DE 2553900 A. Suitable fatty ketones are those prepared by pyrolysis of the magnesium salts of lauric acid, myristic acid, palmitic acid, palmitoleic acid, stearic acid, oleic acid, elaidic acid, petroselic acid, arachidic acid, gadoleic acid, behenic acid or erucic acid.

Further suitable antifoams are fatty acid polyethylene glycol esters, which are preferably obtained by basic-homogeneous catalyzed addition of ethylene oxide onto fatty acids. The addition of ethylene oxide onto the fatty acids takes place in particular in the presence of alkanolamines as catalysts. The use of alkanolamines, specifically triethanolamine, leads to an extremely selective ethoxylation of the fatty acids, in particular when compounds with low degrees of ethoxylation are being prepared. Within the group of fatty acid polyethylene glycol esters, preference is given to those which have a melting point above 25° C., in particular above 40° C.

Within the group of wax-like antifoams, particular preference is given to using the paraffin waxes described alone as wax-like antifoams, or in a mixture with one of the other wax-like antifoams, where the proportion of paraffin waxes in the mixtures preferably constitutes more than 50% by weight, based on wax-like antifoam mixture. The paraffin waxes can be applied to carriers as required. Suitable carrier materials are all known inorganic and/or organic carrier materials. Examples of typical inorganic carrier materials are alkali metal carbonates, aluminosilicates, water-soluble phyllosilicates, alkali metal silicates, alkali metal sulfates, for example sodium sulfate and alkali metal phosphates. The alkali metal silicates are preferably a compound with a molar ratio of alkali metal oxide to $SiO_2$ of from 1:1.5 to 1:3.5. The use of such silicates results in particularly good grain properties, in particular high stability to abrasion and nevertheless high dissolution rate in water. The aluminosilicates referred to as carrier material include, in particular, the zeolites for example zeolite NaA and NaX. The compounds referred to as water-soluble phyllosilicates include, for example, amorphous or crystalline waterglass. It is also possible to use silicates which are available commercially under the name Aerosil® or Sipernat®. Suitable organic carrier materials are, for example, film-forming polymers, for example polyvinyl alcohols, polyvinylpyrrolidones, poly (meth)acrylates, polycarboxylates, cellulose derivatives and starch. Cellulose ethers which can be used are, in particular, alkali metal carboxymethylcellulose, methylcellulose, ethylcellulose, hydroxyethylcellulose and cellulose mixed ethers, such as, for example methylhydroxyethylcellulose and methylhydroxypropylcellulose, and mixtures thereof. Particularly suitable mixtures are composed of sodium carboxymethylcellulose and methylcellulose, where the carboxymethylcellulose usually has a degree of substitution of from 0.5 to 0.8 carboxymethyl groups per anhydroglucose unit and the methylcellulose has a degree of substitution of from 1.2 to 2 methyl groups per anhydroglucose unit. The mixtures preferably comprise alkali metal carboxymethylcellulose and nonionic cellulose ethers in weight ratios of from 80:20 to 40:60, in particular from 75:25 to 50:50. Another suitable carrier is native starch, which is made up of amylose and amylopectin. Native starch is the term used to refer to starch as is available as extract from natural sources, for example from rice, potatoes, corn and wheat. Native starch is a commercially available product and thus readily available. Individual or two or more of the compounds given above can be used as carrier materials, in particular chosen from the group of alkali metal carbonates, alkali metal sulfates, alkali metal phosphates, zeolites, water-soluble phyllosilicates, alkali metal silicates, polycarboxylates, cellulose ethers, polyacrylate/polymethacrylate and starch. Mixtures of alkali metal carbonates, in particular sodium carbonate, alkali metal silicates, in particular sodium silicate, alkali metal sulfates, in particular sodium sulfate and zeolites are particularly suitable.

Suitable silicones are customary organopolysiloxanes which can have a content of finely divided silica which in turn may also be silanized. Such organopolysiloxanes are described, for example, in European patent application EP 0496510 A1. Particular preference is given to using polydiorganosiloxanes which are known from the prior art. It is, however, also possible to use compounds crosslinked via siloxane, as are known to the person skilled in the art under the name silicone resins. The polydiorganosiloxanes usually contain finely divided silica which may also be silanized. Silica-containing dimethylpolysiloxanes are particularly suitable. The polydiorganosiloxanes advantageously have a Brookfield viscosity at 25° C. in the range from 5 000 mPas to 30 000 mPas, in particular from 15 000 to 25 000 mPas. The silicones are preferably applied to carrier materials. Suitable carrier materials have already been described in connection with the paraffins. The carrier materials are generally present in amounts of from 40 to 90% by weight, preferably in amounts of from 45 to 75% by weight, based on antifoam.

Perfume oils and fragrances which may be used are individual odorant compounds, e.g. the synthetic products of the ester, ether, aldehyde, ketone, alcohol and hydrocarbon type. Odorant compounds of the ester type are e.g. benzyl acetate, phenoxyethyl isobutyrate, p-tert-butylcyclohexyl acetate, linalyl acetate, dimethylbenzylcarbinyl acetate, phenylethyl acetate, linalyl benzoate, benzyl formate, ethylmethylphenyl glycinate, allyl cyclohexyl propionate, styrallyl propionate and benzyl salicylate. The ethers include, for example, benzyl ethyl ether, and the aldehydes include, for example, the linear alkanals having 8–18 carbon atoms, citral, citronellal, citronellyl-oxyacetaldehyde, cyclamen aldehyde, hydroxycitronellal, lilial and bourgeonal, and the ketones include, for example, the ionones, α-isomethylionone and methyl cedryl ketone, and the alcohols include anethole, citronellol, eugenol, geraniol, linalool, phenylethyl alcohol and terpineol, and the hydrocarbons include mainly the terpenes, such as limonene and pinene. Preference is, however, given to using mixtures of different odorants which together produce a pleasing fragrance note. Such perfume oils can also comprise natural odorant mixtures as are available from vegetable sources, e.g. pine oil, citrus oil, jasmine oil, patchouli oil, rose oil or ylang ylang oil. Also suitable are clary sage oil, camomile oil, oil of cloves, melissa oil, mint oil, cinnamon leaf oil, linden blossom oil, juniper berry oil, vetiver oil, olibanum oil, galbanum oil and labdanum oil, and orange blossom oil, neroli oil, orange peel oil and sandalwood oil.

The fragrances can be incorporated directly into the compositions according to the invention, although it may also be advantageous to apply the fragrances to carriers which enhance the adhesion of the perfume to the laundry and ensure a slower fragrance release for long-lasting fragrance of the textiles. Examples of such carrier materials which have proven successful are cyclodextrins, in which the cyclodextrin-perfume complexes can additionally also be coated with further auxiliaries.

If desired, the end preparations can also comprise inorganic salts as fillers or extenders, such as, for example, sodium sulfate, which is preferably present in amounts of from 0 to 10% by weight, in particular 1 to 5% by weight, based on compositions.

Preparation of the Detergent Tablets

The moldings are usually prepared by tabletting or compression agglomeration. The resulting particulate compression agglomerates can either be used directly as detergents or after-treated and/or worked up beforehand by customary methods. Customary after-treatments include, for example powderings with finely divided ingredients of detergents or cleaning compositions, as a result of which the bulk weight is generally further increased. A preferred after-treatment, however, is also the procedure according to German patent applications DE 19524287 A1 and DE 19547457 A1, where dust-like or at least finely divided ingredients (the fine fractions) are adhered to the particulate process end products prepared according to the invention which serve as core, thus producing compositions which have these fine fractions as external coating. This in turn advantageously takes place via a melt agglomeration. For the melt agglomeration of the fine fractions, reference is expressly made to the disclosure in German patent applications DE 19524287 A1 and DE 19547457 A1. In the preferred embodiment of the invention, the solid detergents are in tablet form, these tablets preferably having rounded corners and edges for storage and transportation reasons in particular. The basic surface of these tablets can, for example, be circular or rectangular. Multilayer tablets, in particular tablets with 2 or 3 layers, which may also be different in color, are primarily preferred. Blue-white or green-white or blue-green-white tablets are particularly preferred. The tablets can also comprise compressed and uncompressed fractions. Moldings with particularly advantageous dissolution rate are obtained if the granular constituents, prior to compression, have a proportion of particles which have a diameter outside the range from 0.02 to 6 mm of less than 20% by weight, preferably less than 10% by weight. Preference is given to a particle size distribution in the range from 0.05 to 2.0 and particularly preferably from 0.2 to 1.0 mm.

EXAMPLES

Examples 1 to 5, Comparative Examples C1 and C2.

In a washing machine (Miele W 918), 3.5 kg of standard laundry and terry towel (which has been washed twice with a universal detergent for pretreatment) were washed in a complete washing cycle at 90° C. In each case two detergent tablets (40 g) of the composition as in Table 1 were placed in the detergent drawer directly prior to the experiment. After the washing cycle, the terry towel was dried for 24 hours at room temperature and then subjected to a panel test of 20 people. Each person awarded a grade between 1 and 4 (1=hard; 4=very soft). The average gave the evaluation for the products, which are likewise given in Table 1.

TABLE 1

| Detergent composition and soft feel | | | | | | | |
|---|---|---|---|---|---|---|---|
| Composition/ Performance | C1 | 1 | 2 | C2 | 3 | 4 | 5 |
| Dodecylbenzene-sulfonate sodium salt | 4.0 | 4.0 | 4.0 | — | — | — | 5.0 |
| $C_{12/18}$-coconut alcohol sulfate sodium salt | 10.0 | 10.0 | 16.0 | — | — | — | 5.0 |
| $C_{12/18}$-coconut fatty acid sodium salt | 2.0 | 2.0 | — | — | — | — | — |
| $C_{12/18}$-coconut fatty alcohol + 7E0 | 4.0 | 4.0 | — | — | — | — | — |
| $C_{12/14}$-coconut alkyl glucoside | — | — | — | 15.0 | 15.0 | 5.0 | 5.0 |
| $C_{12/18}$-cocoampho-acetate sodium salt | — | — | — | — | — | 10.0 | — |
| Sodium tripoly-phosphate | 25.0 | 25.0 | 25.0 | 25.0 | 25.0 | 25.0 | 25.0 |

TABLE 1-continued

| Detergent composition and soft feel | | | | | | | |
|---|---|---|---|---|---|---|---|
| Composition/ Performance | C1 | 1 | 2 | C2 | 3 | 4 | 5 |
| Collagen coconut fatty acid condensate sodium salt[1)] | — | 5.0 | 5.0 | — | 5.0 | 5.0 | 5.0 |
| Phyllosilicate[2)] | — | — | — | — | — | — | 5.0 |
| Soda | 15.0 | 15.0 | 15.0 | 15.0 | 15.0 | 15.0 | 15.0 |
| Sodium silicate | 5.0 | 5.0 | 5.0 | 5.0 | 5.0 | 5.0 | 5.0 |
| Paraffin/silicone antifoam[3)] | 3.0 | 3.0 | 3.0 | 3.0 | 3.0 | 3.0 | 3.0 |
| Microcrystalline cellulose | 8.0 | 0.0 | 8.0 | 8.0 | 8.0 | 8.0 | 8.0 |
| Sodium sulfate | | | | ad 100 | | | |
| Feel grade | 1.0 | 1.5 | 2.0 | 1.5 | 2.5 | 2.0 | 3.0 |

[1)]Lamepon ® SCE-B
[2)]Bentone ® EW
[3)]Dehydran ® 760

What is claimed is:

1. A detergent composition comprising:

(a) an anionic surfactant selected from the group consisting of an alkylbenzenesulfonate, an alkyl sulfate, a soap, an alkanesulfonate, an olefinsulfonate, a methyl ester sulfonate, and mixtures thereof;

(b) a non-enzymatic protein derivative thereof which derivative comprises a condensation product of a hydrolyzate with a fatty acid having from 6–22 carbon atoms;

(c) a phosphate;

(d) a disintegrating agent; and (e) optionally, a co-surfactant selected from the group consisting of a nonionic surfactant, an amphoteric surfactant, and mixtures thereof, and wherein the detergent composition is in a tablet form.

2. The composition of claim 1 wherein the composition has a total surfactant content of from about 1 to 50% by weight, based on the weight of the composition.

3. The composition of claim 1 wherein the surfactant component is present in the composition in an amount of from about 5 to 25% by weight, based on the weight of the composition.

4. The composition of claim 1 wherein the non-enzymatic protein derivative is present in the composition in an amount of from about 0.1 to 10% by weight, based on the weight of the composition.

5. The composition of claim 1 wherein the non-enzymatic protein derivative is present in the composition in an amount of from about 1 to 8% by weight, based on the weight of the composition.

6. The composition of claim 1 wherein the phosphate is present in the composition in an amount of from about 10 to 60% by weight, based on the weight of the composition.

7. The composition of claim 1 wherein the phosphate is present in the composition in an amount of from about 15 to 25% by weight, based on the weight of the composition.

8. The composition of claim 1 wherein the disintegrating agent is present in the composition in an amount of from about 0.1 to 25% by weight, based on the weight of the composition.

9. The composition of claim 1 wherein the disintegrating agent is present in the composition in an amount of from about 1 to 20% by weight, based on the weight of the composition.

10. The composition of claim 1 wherein the composition is free of cationic surfactant.

11. A process for making a solid-form detergent composition which imparts a soft feel onto clothes treated therewith comprising:

(a) providing an anionic surfactant selected from the group consisting of an alkylbenzenesulfonate, an alkyl sulfate, a soap, an alkanesulfonate, an olefinsulfonate, a methyl ester sulfonate, and mixtures thereof;

(b) providing a non-enzymatic protein derivative thereof which derivative comprises a condensation product of a hydrolyzate with a fatty acid having from 6–22 carbon atoms;

(c) providing a phosphate;

(d) providing a disintegrating agent;

(e) providing, optionally, a co-surfactant selected from the group consisting of a nonionic surfactant, an amphoteric surfactant, and mixtures thereof;

(f) mixing (a)–(e) to form a detergent mixture; and (g) forming the detergent mixture into a tablet.

12. The process of claim 11 wherein the composition has a total surfactant content of from about 1 to 50% by weight, based on the weight of the composition.

13. The process of claim 11 wherein the surfactant component is present in the composition in an amount of from about 5 to 25% by weight, based on the weight of the composition.

14. The process of claim 11 wherein the non-enzymatic protein derivative is present in the composition in an amount of from about 0.1 to 10% by weight, based on the weight of the composition.

15. The process of claim 11 wherein the non-enzymatic protein derivative is present in the composition in an amount of from about 1 to 8% by weight, based on the weight of the composition.

16. The process of claim 11 wherein the phosphate is present in the composition in an amount of from about 10 to 60% by weight, based on the weight of the composition.

17. The process of claim 11 wherein the phosphate is present in the composition in an amount of from about 15 to 25% by weight, based on the weight of the composition.

18. The process of claim 11 wherein the disintegrating agent is present in the composition in an amount of from about 0.1 to 25% by weight, based on the weight of the composition.

19. The process of claim 11 wherein the disintegrating agent is present in the composition in an amount of from about 1 to 20% by weight, based on the weight of the composition.

20. The process of claim 11 wherein the composition is free of catlonic surfactant.

* * * * *